US011367970B2

(12) United States Patent
Henke et al.

(10) Patent No.: US 11,367,970 B2
(45) Date of Patent: Jun. 21, 2022

(54) SERIES TERMINAL ASSEMBLY AND METHOD FOR IMPLEMENTING WIRING ON A MATRIX OF CONDUCTOR CONNECTION DEVICES

(71) Applicant: Weidmüller Interface GmbH & Co. KG, Detmold (DE)

(72) Inventors: Ralf Henke, Brühl (DE); Frank Hackemack, Detmold (DE); Andreas Rutz, Bielefeld (DE)

(73) Assignee: Weidmüller Interface GmbH & Co. KG

( * ) Notice: Subject to any disclaimer, the term of this patent is extended or adjusted under 35 U.S.C. 154(b) by 62 days.

(21) Appl. No.: 16/500,137

(22) PCT Filed: Mar. 20, 2018

(86) PCT No.: PCT/EP2018/057066
§ 371 (c)(1),
(2) Date: Oct. 2, 2019

(87) PCT Pub. No.: WO2018/184834
PCT Pub. Date: Oct. 11, 2018

(65) Prior Publication Data

US 2021/0021062 A1 Jan. 21, 2021

(30) Foreign Application Priority Data

Apr. 3, 2017 (DE) ..... 102017107084.2

(51) Int. Cl.
*H01R 9/24* (2006.01)
*H01R 9/26* (2006.01)

(52) U.S. Cl.
CPC ..... *H01R 9/2475* (2013.01); *H01R 9/2625* (2013.01); *H01R 9/2683* (2013.01)

(58) Field of Classification Search
CPC ... H01R 3/00; H01R 4/48; H01R 9/26; H01R 9/2475; H01R 9/2625; H01R 9/2683; H01R 13/648
(Continued)

(56) References Cited

U.S. PATENT DOCUMENTS 3,936,567 A * 2/1976 Vesely ..... B32B 27/00 428/325
4,940,431 A * 7/1990 Hennemann ..... H01R 9/26 439/715
(Continued)

FOREIGN PATENT DOCUMENTS

CN 106170893 A 11/2016
DE 202004009980 U1 11/2005
(Continued)

*Primary Examiner* — William H. Mayo, III
(74) *Attorney, Agent, or Firm* — Laubscher & Laubscher, P.C.

(57) ABSTRACT

A method for implementing-a wiring on a matrix of conductor connection devices such as terminal conductor connection devices for connection of the ends of a conductor to at least one series terminal block uses at least one luminous element to identify conductor connection devices which are illuminated in the matrix directly or indirectly in accordance with a wiring diagram. The conductor connection devices that are illuminated by the luminous element and that are to be interconnected are connected to conductors, the ends of which are inserted in the conductor connection devices to establish a respective conducting wiring connection.

18 Claims, 8 Drawing Sheets

(58) Field of Classification Search
USPC ..... 439/608, 716, 532, 94, 715, 717, 296, 439/507, 709, 711–713, 718
See application file for complete search history.

(56) References Cited

U.S. PATENT DOCUMENTS

| | | | | |
|---|---|---|---|---|
| 6,784,802 | B1 * | 8/2004 | Stanescu | H04Q 1/138 340/687 |
| 8,460,038 | B2 * | 6/2013 | Eisert | H01R 9/2625 439/716 |
| 8,827,739 | B2 * | 9/2014 | Hanses | H01R 4/4836 439/441 |
| 10,062,978 | B2 | 8/2018 | Henke | |
| 2007/0049129 | A1 * | 3/2007 | Pollmann | H01R 9/2675 439/716 |
| 2007/0102505 | A1 | 5/2007 | Yokota et al. | |
| 2007/0178742 | A1 | 8/2007 | Shigemi et al. | |
| 2009/0017682 | A1 * | 1/2009 | Amleshi | H01R 13/6471 439/607.05 |
| 2009/0111334 | A1 | 4/2009 | Diekmann | |
| 2011/0059658 | A1 | 3/2011 | Eisert et al. | |
| 2013/0052884 | A1 | 2/2013 | Hanses | |

FOREIGN PATENT DOCUMENTS

| | | | | |
|---|---|---|---|---|
| DE | 102008014177 | A1 | 9/2009 | |
| DE | 202008013610 | U1 | 3/2010 | |
| DE | 102010009804 | A1 | 9/2011 | |
| DE | 202010014008 | U1 | 1/2012 | |
| DE | WO2015/150075 | A1 * | 10/2015 | H01R 9/26 |
| EP | 0185518 | A2 | 6/1986 | |
| EP | 1610284 | A1 | 12/2005 | |
| WO | 2015150075 | A1 | 8/2015 | |

* cited by examiner

SERIES TERMINAL ASSEMBLY AND METHOD FOR IMPLEMENTING WIRING ON A MATRIX OF CONDUCTOR CONNECTION DEVICES

This application is a § 371 National Stage Entry of PCT/EP2018/057066 filed Mar. 20, 2018. PCT/EP2018/057066 claims priority of DE 102017107084.2 filed Apr. 3, 2017. The entire contents of these applications are incorporated herein by reference.

BACKGROUND OF THE INVENTION

The invention relates to a method for implementing wiring on a matrix of conductor connection devices, in particular terminal conductor connection devices, for connection of conductor ends to at least one series terminal block or a plurality of series terminal blocks that each include a plurality of series terminals on a wiring device. The invention also relates to a series terminal assembly.

Control devices for low, medium, or high-voltage switchgears are required for energy transmission and distribution. The control devices also perform monitoring, protection, and/or measuring functions, in addition to control functions. To do this, various electrical components, such as protective or auxiliary relays, electrical and/or mechanical switches, buttons, lights, and/or measurement and/or display instruments for current, voltage, output, and/or frequency, are connected to one another. To ensure their functionality, such switchgears must be configured by wiring their components in a particular manner. In doing so, there may be significant complexity in the wiring based on the number of various required functions.

In order to adapt such switchgears more easily and quickly, series terminal assemblies are used in which input-side plug-in slots are connected to one another for connecting electrical plugs or conductors with output-side plug-in slots via busbars. The busbars are connected to one another via pluggable transverse bridges in the series direction of the series terminals or within a series terminal in order to connect the input-side plug-in slots to the output-side plug-in slots.

DE 20 2008 013 610 U1 discloses such a series terminal assembly. With this series terminal assembly, each input-side plug-in slot is connected to an output-side plug-in slot via a busbar. Moreover, it is possible to connect various types of connectors via connectors which can be aligned perpendicular to one another. Also disclosed is a design with which a plug which is configurable with connectors, is placed on the series terminal assembly in order to suitably connect the input- and output-side connections. However, the assembly does not enable the input-side plug-in slots to be connected to one another without simultaneously connecting the output-side plug-in slots, which are connected with the input-side plug-in slots via the busbars to one another. And conversely, the assembly thus does not enable the output-side plug-in slots to be connected to one another without simultaneously connecting the input-side plug-in slots, which are connected with the output-side plug-in slots via the busbars to one another.

A series terminal assembly for a medium-voltage switchgear is known from WO 2015/150075 A1. The assembly includes at least two input-side plug-in slots and at least two output-side plug-in slots, between which a configuration slot is provided, wherein the input-side plug-in slots and the output-side plug-in slots are not electrically connected to one another in a manner that is permanently preconfigured via conductors or other busbars of the terminal assembly. Furthermore, the configuration slot includes a configuration plug-in slot for each input-side plug-in slot and for each output-side plug-in slot. Input-side and output-side configuration plug-in slots can thus be individually connected using conductors. In addition, it is possible to connect individual input-side plug-in slots with one another without simultaneously also connecting output-side plug-in slots. Furthermore, it is possible to interconnect individual output-side plug-in slots without simultaneously also connecting input-side plug-in slots.

SUMMARY OF THE INVENTION

Against this backdrop, the object of the invention is to provide a further optimized terminal assembly which is also easy to handle. A simple method is provided for implementing wiring on a matrix of conductor connection devices, in particular terminal conductor connection devices for connection of conductor ends, to at least one series terminal block or a plurality of series terminal blocks that each include a plurality of series terminals.

A method is provided for implementing wiring on a matrix of conductor connection devices for connection of conductor ends to at least one series terminal block or a plurality of series terminal blocks that each include a plurality of series terminals, on or by a wiring device. To this end, a wiring device is provided which includes a computing device or to which such a device has been assigned which is provided with a program for creating a wiring diagram on the series terminal block. In addition, one or more luminous elements are provided. Furthermore, the at least one series terminal block is provided and conductors with conducting ends such as stripped ends are provided.

According to the method, the following steps are implemented:

- a wiring diagram is created with a program for creating the wiring diagram;
- using at least one luminous element, terminal conductor connection devices to be interconnected according to the wiring diagram are illuminated in the matrix;
- the terminal conductor connection devices that are illuminated by the luminous elements and that are to be interconnected are connected to conductors, the ends of which are inserted in the terminal conductor connection devices to be interconnected, thereby establishing a respective conducting wiring connection;
- the conducting wiring connection is tested with a test device wherein when the conducting wiring connection is classified as being functional. The illumination and connecting steps are then repeated until the wiring diagram is completely implemented and the wiring to be created is complete and wherein, when the respective conducting wiring connection is not classified as being functional, the wiring connection is disconnected and re-connected and tested.

When the wiring is completely created, a final functional testtakes place on the wiring device with the program, and the series terminal assembly is only then disconnected as a whole from the wiring device with the test device and installed at an application site in the field.

The ends of the conductors can be placed into the conductor connection devices either manually or with an assembly robot.

If necessary, a test log can be displayed or generated. An advantage of the method is that changes in the wiring can be implemented quickly. After implementation of a first wiring, a second wiring is created using the method from the first wiring, in that pairs of connections to be disconnected and connections to be reconnected are displayed and created.

The wiring device and/or the program can be designed such that a wire length, a line cross-section, and optionally a color of the conductor to be used are proposed and implemented.

The conductor connection devices to be interlinked, particularly the terminal conductor connection devices, may include the configuration plug-in slots of a terminal assembly.

The wiring method can be implemented automatically with an assembly robot or alternatively by a person, who creates the necessary wiring connections through use of illumination of the terminal conductor connection devices.

This method can be used with a series terminal assembly, having at least two or more sequential series terminals, each of which has one or more conductor connection devices, particularly terminal conductor connection devices wherein one, several, or all of the conductor connection devices have a reflection device assigned for reflecting incidental light. This makes it significantly easier to detect the respectively illuminated series terminals.

The terminal conductor connection devices and/or the corresponding plug-in connections are connected to one another by conductors, i.e. with flexible or rigid wires, busbars, jumpers, or with at least one PC board equipped with traces.

A terminal assembly and particularly a series terminal assembly such as for a medium-voltage switchgear includes at least two input-side plug-in slots, at least two output-side plug-in slots and a configuration slot, wherein the input-side plug-in slots and the output-side plug-in slots are not permanently electrically connected to one another, and wherein the configuration slot comprises a configuration plug-in slot for each input-side plug-in slot and for each output-side plug-in slot. The configuration plug-in slot is provided with a conductor connection device, wherein the configuration plug-in slots can be connected to conductors and one or more electrical or electronic functional components are connected on at least a part of the input- or output-side plug-in slots.

BRIEF DESCRIPTION OF THE FIGURES

Other objects and advantages of invention will be described with reference to the accompanying drawing, in which.

DETAILED DESCRIPTION

Figure 1A:
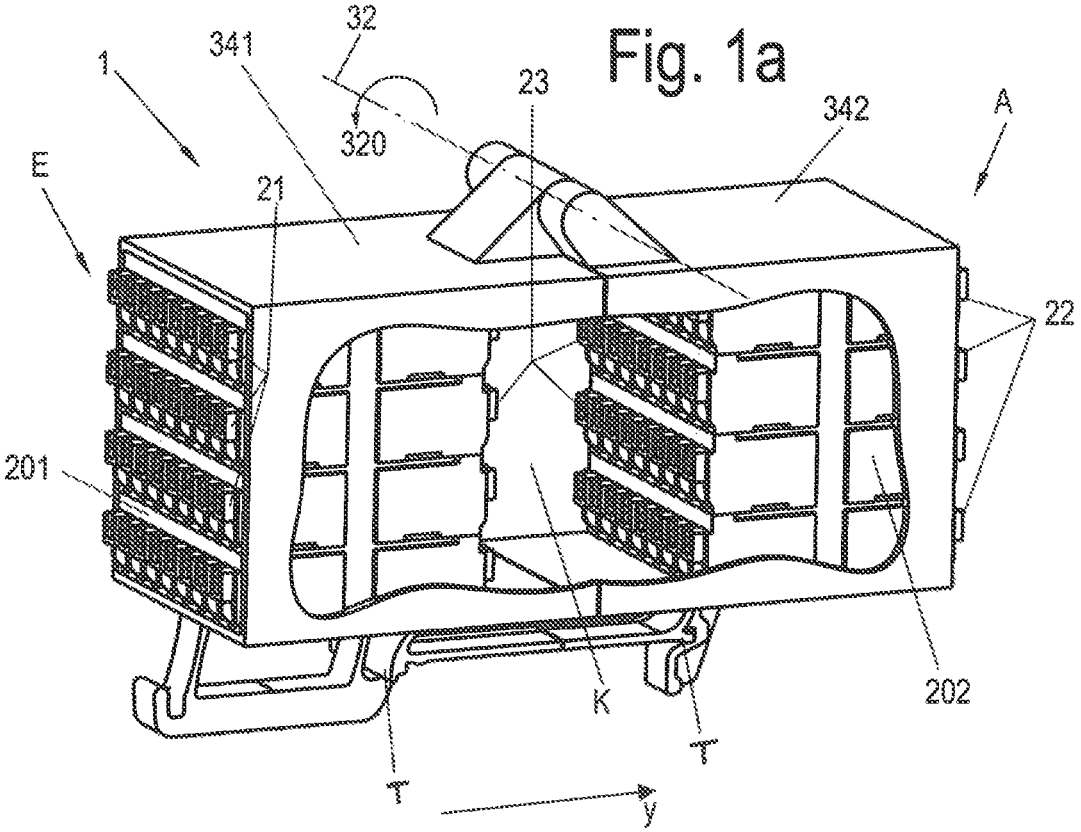
FIGS. 1*a* and 1*bis* are a front perspective cutaway and a front perspective view, respectively of a first terminal assembly.

FIG. 1 shows a terminal assembly 1. It has at least one series terminal block. Preferably, it has a first terminal block 201 and a second terminal block 202 which are similar. The first terminal block 201 and the second terminal block 202 are preferably arranged as mirror images so that an input side E and an output side A are arranged on opposite sides of the terminal assembly 1 in the extension direction 53 as shown in FIG. 1*f*.

In the embodiment shown, configuration plug-in slots 23 are each arranged flush with input-side or output-side connections, preferably plug-in slots 21 and 22, respectively. The plug-in slots 21, 22 may be formed in different ways. They may be formed by conductor connection devices for connecting a conductor and/or a conductor end. They can be formed, for example, as terminal conductor connection devices, particularly as direct plug-in connections with a clamping spring, which is used to press conductors pushed into a terminal against a busbar. The plug-in slots 21, 22 may also be designed with different connection technology such as tension spring connections, insulation-piercing connections, screw terminals, or the like.

Figure 4:
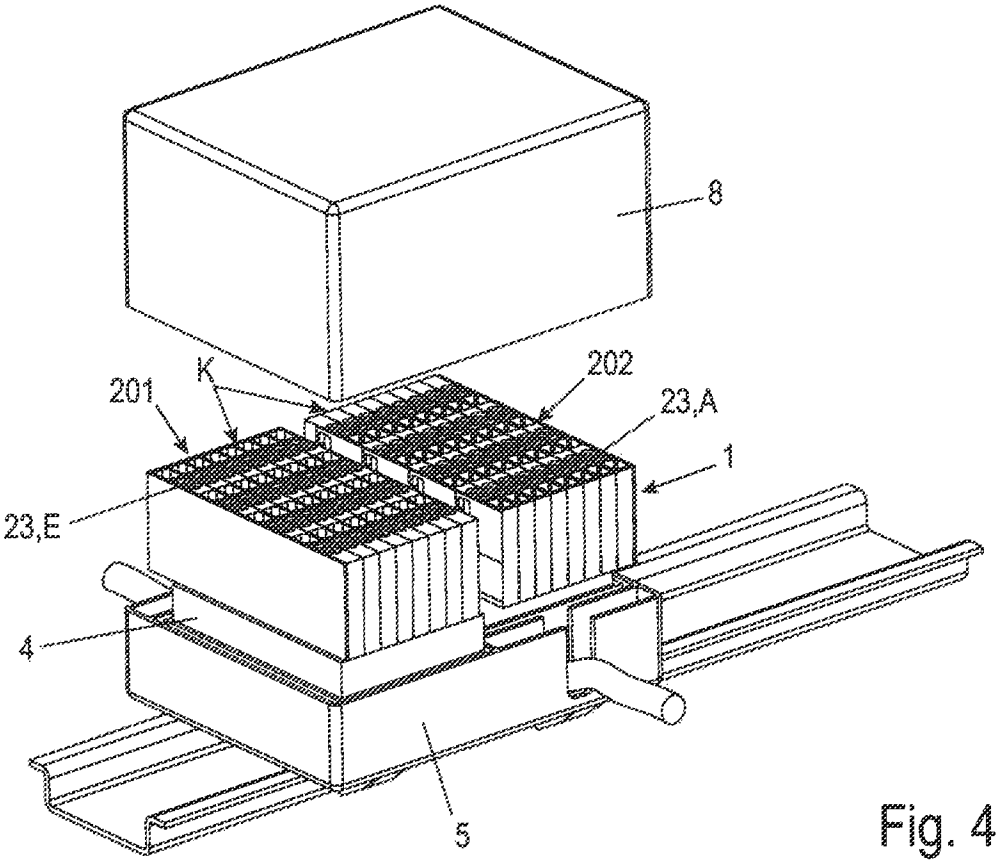
FIG. 4 is an exploded perspective view of a fourth terminal assembly.
Figure 5:
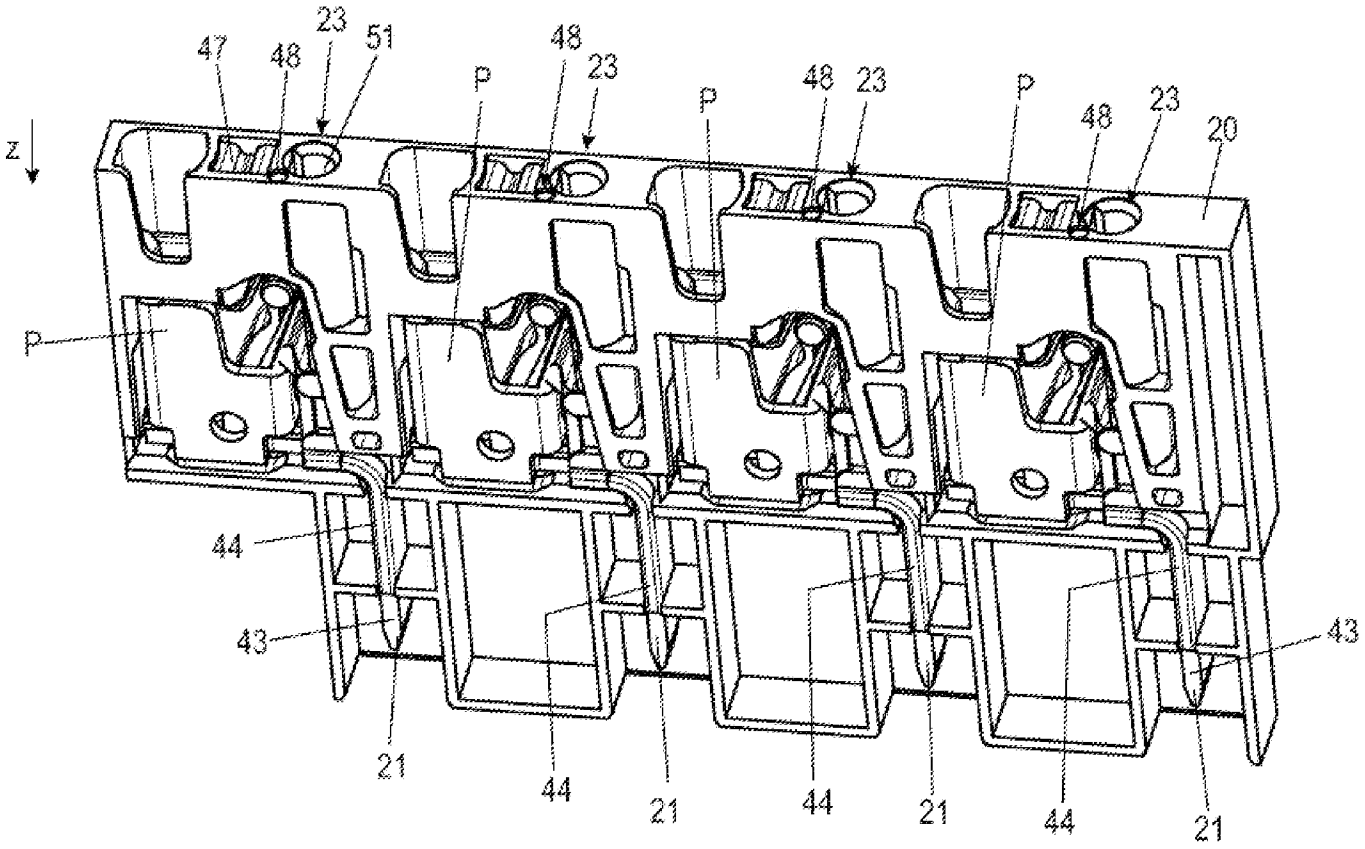
FIG. 5 is a front perspective view of a series terminal for a terminal assembly.

The plug-in slots 21 and/or 22 may also be formed, for example, as individual plug-in slots, either as plug-in pins or sockets, of a prioritized plug-in connector. Then it is only necessary to connect a mating connector to each of these plug-in slots 21 and/or 22, to which conductors are routed individually or as a cable harness with multiple conductors. Such a design is shown in FIGS. 4 and 5 as will be described below.

Plug-in slots 21 and/or 22 may also be designed such that multiple conductors are combined as a cable, for example, for connection with at least one PC board, to which the ends of the conductors are soldered. The conductor soldered in this manner is also considered as connected to a 'plug-in slot 21 and/or 22.' Plug-in slot 21 and/or 22 is then the connection slot for the conductor on the PC board (not shown).

Plug-in slots 21 and/or 22 are electrically connected to the configuration plug-in slots 23 via conducting busbars or the like.

The first series terminal block 201 and the second series terminal block 202 are spaced depart from one another in the extension direction Y. The terminal slot K is thus arranged between the first series terminal block 201 and the second series terminal block 202.

Furthermore, the first series terminal block 201 and the second series terminal block 202 are each arranged in a housing 341, 342 in the embodiment shown in FIG. 1*a*.

In FIG. 1*a*, parts of the housing 341, 342 have been omitted or hidden so that the terminal slot K between the first series terminal block 201 and the second series terminal block 202 is visible.

To ensure that the terminal slot K for electrically connecting the input-side plug-in slots 21 to the output-side plug-in slots 22 is accessible to users by a connection of the configuration plug-in slots 23, the two housings 341, 342 are provided to pivot relative to one another about a pivoting axis 32 in a pivot direction 320. This is an advantageous design that is easy to manufacture. However, it is not a mandatory design.

Figure 1B:
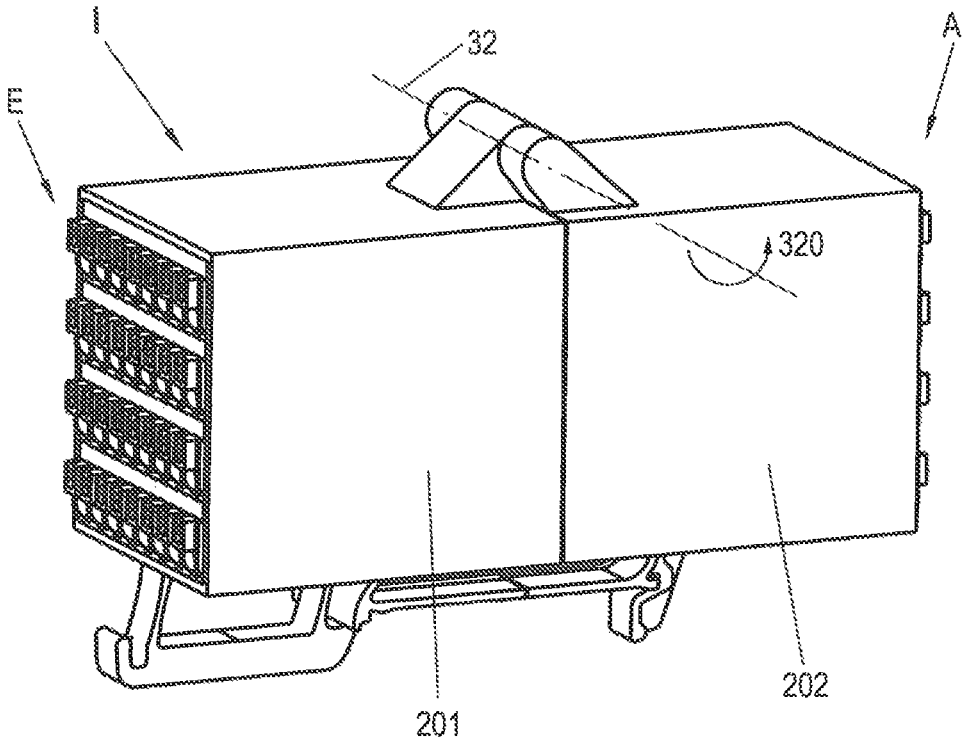
Figure 1C:
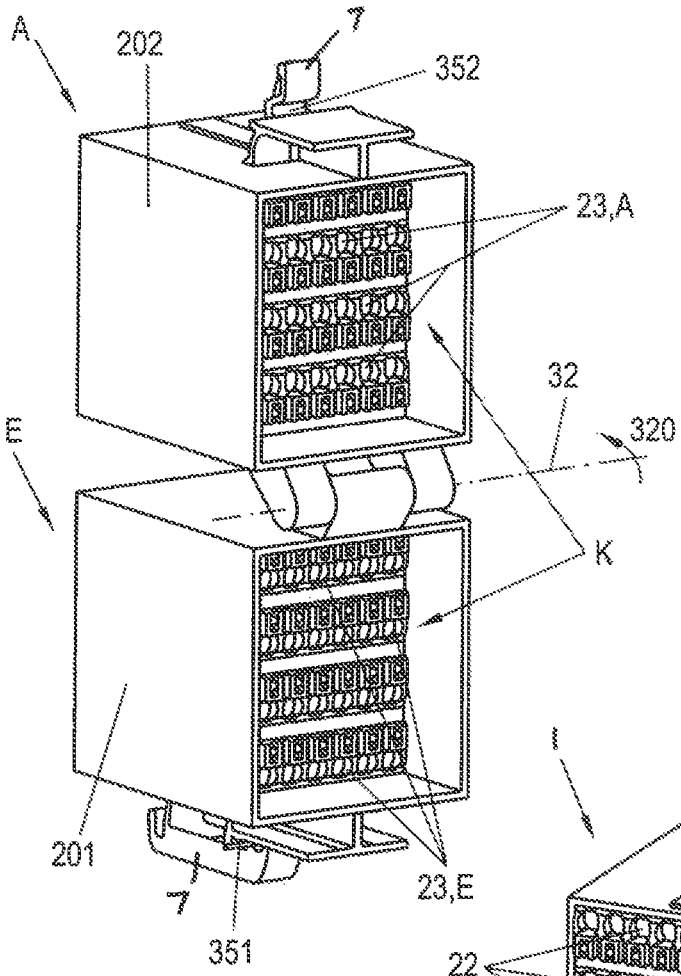
FIGS. 1*c* and 1*d* are front and rear perspective views of the first terminal assembly in an open position, respectively.
Figure 1D:
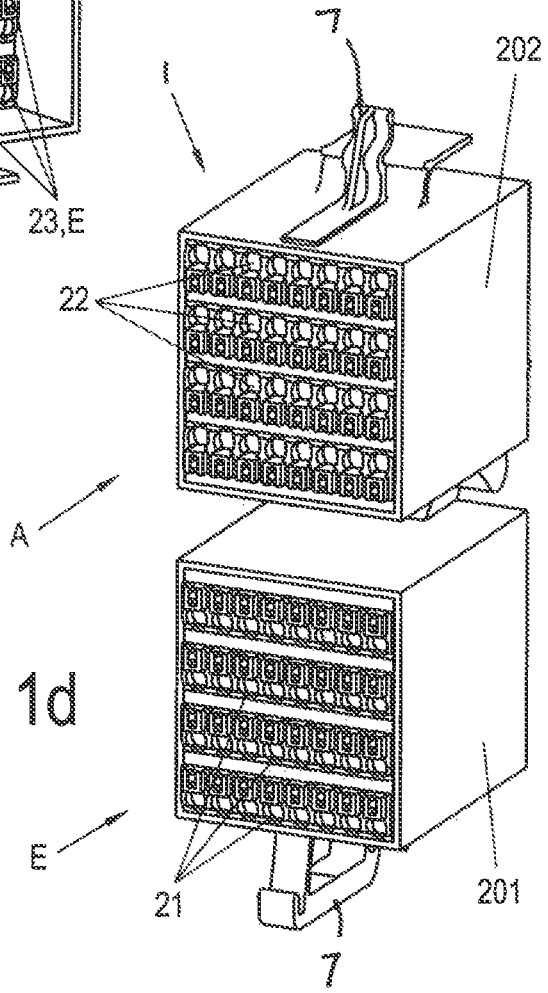
Figure 1E:
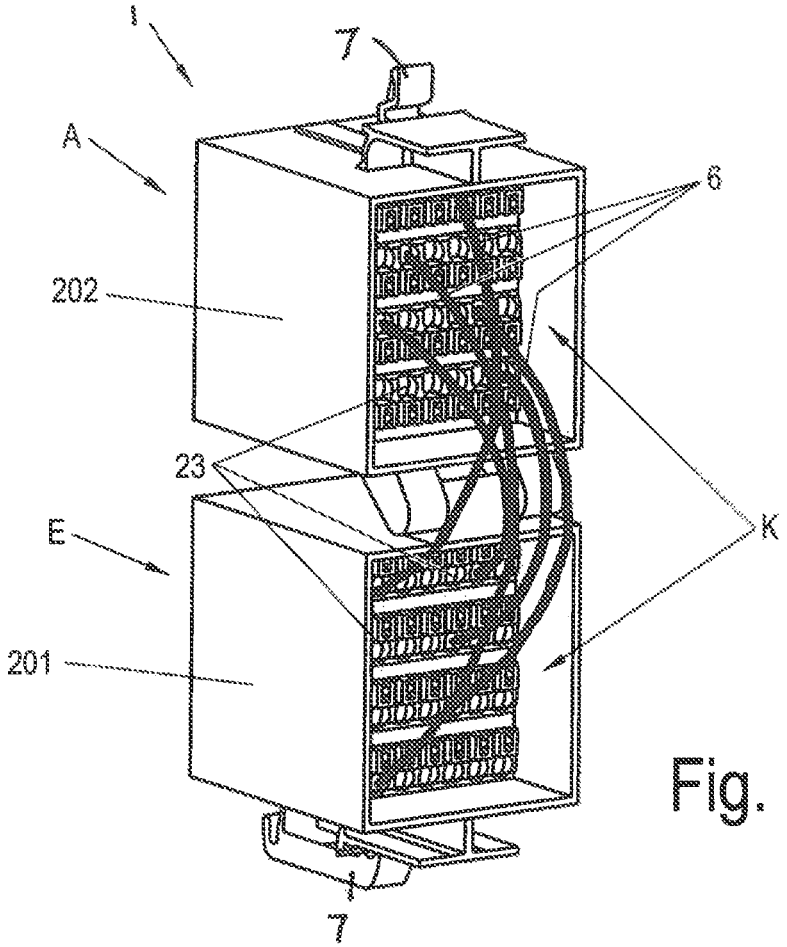
FIG. 1*e* is a front perspective view of the first terminal assembly with electrical conductors in an open position.

FIG. 1*b* shows the terminal assembly of this embodiment without the housing cutouts. FIGS. 1*c*-1*e* show the terminal assembly wherein the housing 342 of the second series terminal block 202 is pivoted by 180° about the pivoting axis 32 in the pivot direction 320 relative to the housing 341 of the first series terminal block 201. The housings 341, 342 are thus in an open condition. The terminal slot K is then accessible to users from the outside. Users can thus wire the assembly and individually connect the conductor connection devices to one another in a conducting manner. Each of these connections is described below as a conducting wiring connection.

The terminal slot K is accessible in this manner and is shown with the configuration plug-in slots 23 in FIGS. 1*c* and 1*e*. FIG. 1*d* shows the input side E with the input-side plug-in slots 21 and the output side A with the output-side plug-in slots 22 of the terminal assembly 1. Accordingly, the configuration plug-in slots 23 are shown as configuration plug-in slots 23,A and 23,E in FIG. 1*c*.

FIG. 1*e* shows a preferred configuration of the terminal slot K. In order to electrically connect the input-side plug-in slots 21 and the output-side plug-in slots 22 with one another, bendable electrical conductors 6 are provided, the stripped and/or noninsulated ends of which are inserted into the conductor connection devices provided and/or formed at the configuration plug-in slots 23,A; 23,E.

With the configuration shown, all of the electrical conductors 6 which are inserted into such configuration plug-in slots 23,A; 23,E connect one of the input-side plug-in slots 21 with one of the output-side plug-in slots 22. To this end, a configuration plug-in slot 23,E, which is connected to an input-side plug-in slot 21, is connected to a configuration plug-in slot 23,A which is connected to an output-side plug-in slot 22 by an electrical conductor 6.

A configuration in which electrical conductors 6 only connect input-side plug-in slots 21 or only output-side plug-in slots 22 to one another is also possible. To do this, an electrical conductor 6 connects configuration plug-in slots 23, which are connected only to input-side plug-in slots 21, with one another or to configuration plug-in slots 23, which are connected only to output-side plug-in slots 22.

Figure 1F:
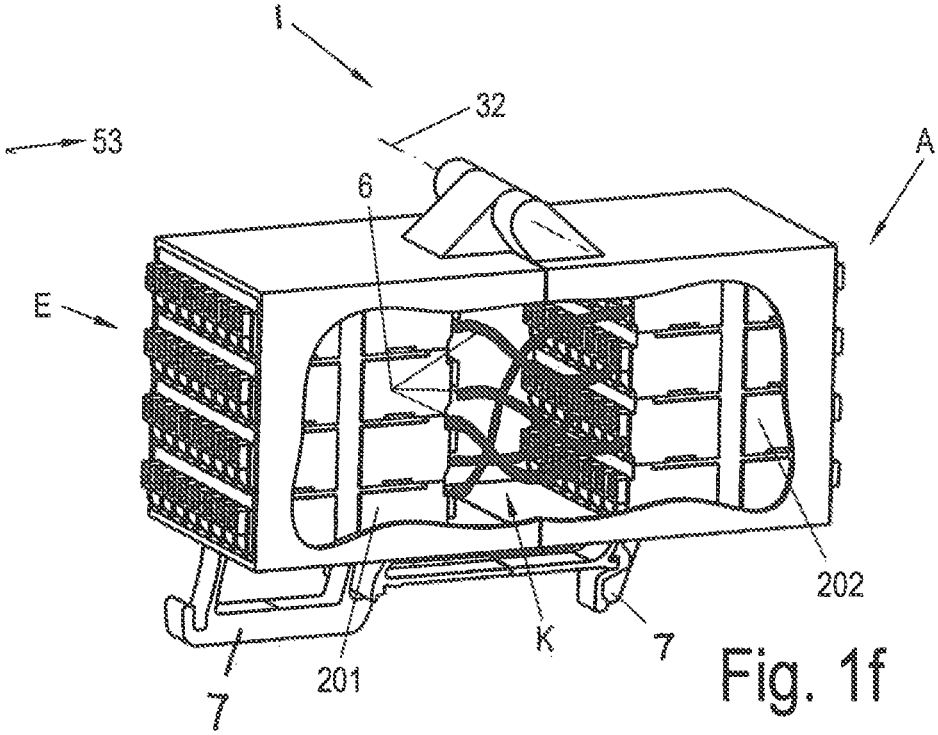
FIG. 1*f* is a front perspective cutaway view of the first terminal assembly with electrical conductors in a closed position.

Parts of the housing 341, 342 of the terminal assembly 1 are also omitted in FIG. 1*f* so that the terminal slot is visible. FIG. 1*f* shows the completely assembled terminal assembly 1 with closed parts 341, 342.

Figure 2A:
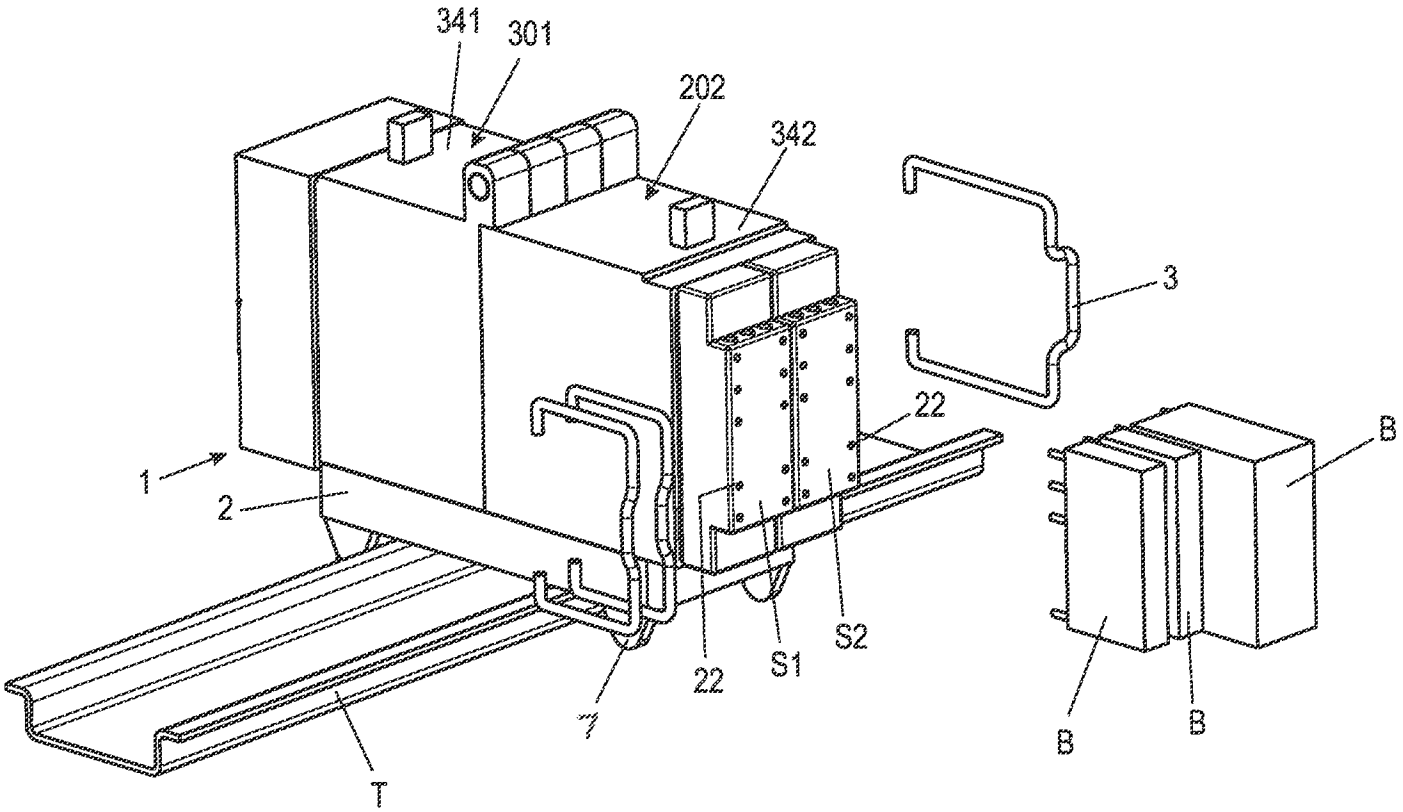
FIGS. 2*a* and 2*b* are exploded and assembled perspective views, respectively, of two terminal assemblies of similar construction.
Figure 2B:
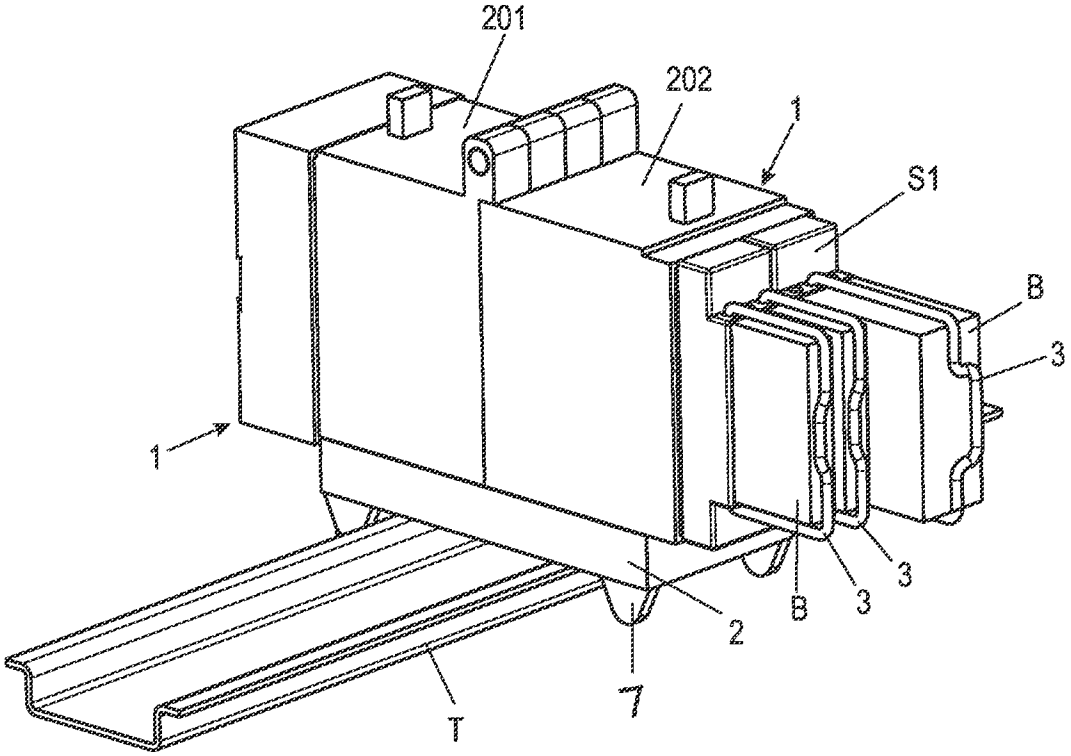

In an alternate embodiment shown in FIGS. 2*a* and 2*b*, one of the plug-in slots 21 or 22 is designed for connection with one or more electrical functional components B and/or are connected after the placement of these functional components B. In the embodiment shown, the components B are connected with the output-side plug-in slots 22.

In this manner, various input-side plug-in slots 21 can be connected to one another via the configuration plug-in slots 23A, 23E, and the conductors 6 are connected to one another via functional components B, depending on a desired configuration to be created. The electrical conductors 6 for connecting the configuration plug-in slots 23A and/or 23B are not shown in FIGS. 2*a* and 2*b*.

In order to implement the output-side plug-in slots 22, base elements S1 are provided for housing parts 341 or 342. The base elements S1 have plug-in slots 22, e.g. in the form of sockets, into which conductor ends or pins or the like of the functional components B can be inserted.

An attachment device such as a bracket 3, which can be provided on the housing 342 and/or on the base element S1, may additionally be provided to secure the respective functional component B to the housing 342 and/or to the base element S1 as shown in FIG. 2*b*.

The functional components B may have or form a variety of electrical or electronic structural elements and implement corresponding electrical or electronic functions. Thus, they may have one or more switches or relays. Various integrated circuits may also be provided as a functional component or components.

The two series terminal blocks 201, 202 of FIGS. 2*a* and 2*b* are clamped or latched into a base 2. The base 2 is formed with a mounting foot 7 for attachment to a mounting rail T. The mounting rail T is a top-hat rail. The main extension direction of the mounting rail T is identified as direction X. According to FIGS. 1*a*-1*f*, however, the mounting foot 7 is formed directly on one or both of the series terminal blocks and is formed, as a whole, when the two series terminal blocks 201, 202 pivot together.

The base 2 is designed to be open in the Z direction on its side facing away from the mounting rail T, such that the two series terminal blocks 201, 202 can be inserted into the housing lower part 5 next to one another.

Figure 3:
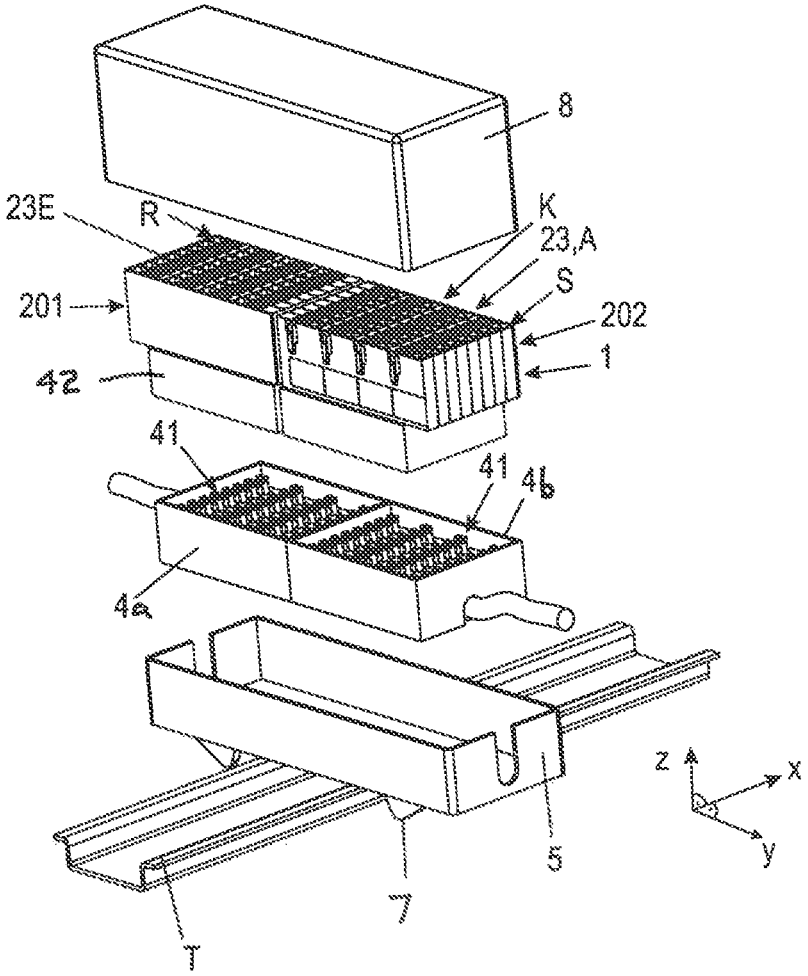
FIG. 3 is an exploded perspective view of a third terminal assembly.

FIG. 3 shows a further embodiment of the terminal assembly 1 with a first series terminal block 201 and a second series terminal block 202.

Plug-in slots 21 and/or 22 are formed as individual plug-in pins or sockets of respective prioritized first and second plug-in connectors, which form the respective series terminal blocks 201 and/or 202 together with the individual terminals 20 in a row one after the other. To that end, the individual terminals 20 can be inserted into a frame or housing 50 which holds them together as a type of assembly unit. In doing so, the plug-in slots 21, 22 are formed as sockets or pins (with pins being shown in FIG. 5) on the bottom side of the first series terminal block 201 and of the second series terminal block 202 which interact with corresponding pins or sockets (i.e. sockets 41) of respective first and second mating connectors 4*a*, 4*b*, to which a cable and/or a cable harness 42 is connected. The conductors are connected to the sockets 41 in a conventional manner not shown.

The two mating connectors 4*a*, 4*b* can be inserted into a housing lower part 5 next to one another. This housing lower part 5 is formed here with a mounting foot 7 for attachment to a mounting rail T. The mounting rail T is a top-hat rail. The main extension direction of the mounting rail T is identified as direction X. The housing lower part 5 is designed to be open in the Z direction on its side facing away from the mounting rail T such that the two mating connectors 4*a*, 4*b* can be inserted into the housing lower part 5 next to one another.

The design of the two mating connectors 4*a*, 4*b* is preferably such that the contacts (sockets 41 or pins) of the two mating connectors 4*a*, 4*b* are aligned in a common plane. Preferably, the contacts 41 are furthermore aligned such that they can be contacted from a direction Z perpendicular to the mounting rail (from above). A type of matrix connector panel is formed from the contacts 41 of the two mating connectors 4.

The two terminal blocks 201 and 202 are placed on this matrix connector panel like plug-in connectors—preferably already equipped with wired conductors 6 (not shown)—such that the contacts thereof such as contact pins 43 provided on the input-side plug-in slots 21, 22 make contact with the contacts such as sockets 41 of the two mating connectors 4*a*, 4*b*. The two terminal blocks, in turn, have the configuration plug-in slots 23 on the side facing away from the mounting rail T.

The plug-in sockets preferably lie in rows and columns so that a terminal slot K with a flat matrix is formed from the configuration plug-in slots 23A, 23E on the side of the two terminal blocks 21, 22 facing away from the mounting rail as shown in FIG. 1*e*.

These configuration plug-in slots 23 are preferably formed as conductor connection devices—particularly as push-in connections with a clamping spring for directly plugging the ends of the conductor into the respective connection. They are preferably connected to one another with jumper elements, particularly with bendable conductors having non-insulated, particularly stripped, conductor ends as shown in FIG. 1*e*. Subsequently, a housing upper part 8 is preferably placed such that it can be latched to the housing lower part 5.

In doing so, configuration plug-in slots 23A and 23E may be arranged next to one another in the mounting rail direction X or perpendicular to the mounting rail and next to one another as shown in FIGS. 3 and 4.

FIG. 5 shows an example of a series terminal 20 for a series terminal block 201, 202 similar to that shown in FIGS. 3 and 4. The series terminal 20 has plug-in slots 21. They are formed by pins 43. Alternatively, they may be formed by sockets.

The plug-in slots are each connected to the configuration plug-in slots 23 by a busbar 44. They are each formed as push-in connections P and have a clamping spring 45 and preferably a clamping ring. With the clamping spring 45, the stripped end of a conductor 6 can be pressed against the busbar 44 or jammed there. The conductor ends can be inserted in an insertion direction Z. Pushers 47 are provided for disconnecting the connections. Such push-in connections P are well-known.

In order to implement simple connecting of the configuration plug-in slots 23, each of which are to be connected with one of the conductors 6, it is necessary to insert conductors with stripped ends using the configuration plug-in slots 23 arranged in pairs according to a wiring diagram for a respective application case.

The corresponding configuration plug-in slots 23 are very easy to detect based on the matrix-like assembly with rows and columns of configuration plug-in slots 23. A person who undertakes the connection with conductors 6 according to the respective wiring diagram connects the corresponding configuration plug-in slots 23 and/or their direct plug connections P with the conductors 6 to one another sequentially according to the respective wiring diagram. Alternatively, this connection of the conductors can be carried out completely automatically, for example, by an assembly robot. The manual connection of related configuration plug-in slots 23 to one another according to a wiring diagram is further simplified when at least one luminous element is provided and with which the configuration plug-in slots to be interlinked can be illuminated. Preferably, the luminous element is a laser or an LED. Related and/or conducting configuration plug-in slots 23 to be interlinked are illuminated with the luminous elements. To this end, it is advantageous to assign a reflector 48 to each of the configuration plug-in slots 23, as shown for example in FIG. 5, and that is preferably on the upper side of the series terminal. This reflector 48 reflects light radiated thereupon when the associated luminous element is activated. The person carrying out the wiring inserts the conductor ends of the conductor 6 into the easy-to-detect configuration plug-in slots.

In this case, a reflector 48 is arranged on the terminal 20 between the pusher 47 and the opening 51 for inserting a conductor 6.

A measurement on a test device determines whether the conductors 6 have been inserted into the correct configuration plug-in slots 12. If a current flows between two configuration slots and/or the conductors connected thereto, after insertion of two conductors and/or conductor ends of a conductor 6, the corresponding connection is established. If the connection is established correctly, two further related plug-in slots are indicated by the luminous element(s). Subsequently, the process repeats itself, preferably, until a wiring to be created has been completely implemented and all pairs of configuration plug-in slots 23 to be interlinked are connected to one another.

Then it is only necessary to connect a mating connector to each of these plug-in slots 21 and/or 22, to which conductors are routed individually or as a cable harness with multiple conductors.

The first series terminal block 201 and the second series terminal block 202 in the example shown each include two connection plugs of seven rows and four columns arranged next to one another, the plug-in slots 21, 22 of which are formed as pins.

The number of plug-in slots 21, 22 can be modified by the number of corresponding connection plugs and/or the number of their rows R or columns S as shown for example in FIG. 3.

The invention claimed is:

1. A method for wiring a matrix of conductor connection devices for connection of ends of conductors to a plurality of terminals of at least one terminal block, comprising the steps of (a) creating a wiring diagram;

(b) selectively illuminating a pair of conductor connection devices to be interconnected according to the wiring diagram with incidental light via a reflector arranged adjacent to said conductor connection devices;

(c) inserting ends of a conductor into said pair of conductor connection devices to establish a wiring connection between said conductor connection devices via said conductor;

(d) testing said wiring connection to confirm that it is functional; and (e) in the event said testing step determines that said wiring connection is not functional, disconnecting said wiring connection and repeating said illuminating, inserting and testing steps.

2. A method as defined in claim 1, wherein said inserting step is performed one of manually and robotically.

3. A method as defined in claim 1, and further comprising repeating the inserting and testing steps if a previous testing step confirms that a wiring connection is functional until said wiring diagram is completed.

4. A method as defined in claim 3, and further comprising a final testing step of following completion of said wiring diagram to confirm that all of the wiring connections are functional.

5. A method as defined in claim 3, and further comprising the step of generating a test log after each testing step.

6. A method as defined in claim 3, wherein after completion of a first wiring diagram, a second wiring diagram is created and each pair of conductor connection devices which are to be disconnected are illuminated and ends of corresponding conductors are removed from said illuminated conductor connection devices for reconnection with another pair of conductor connection devices according to said second wiring diagram.

7. A method as defined in claim 1, wherein said wiring diagram specifies parameters of each conductor.

8. A method as defined in claim 1, wherein said conductor comprises one of a flexible or rigid wire, a busbar, and a jumper cable.

9. A series terminal assembly, comprising (a) at least two series terminals each including at least one conductor connection device;

(b) a reflector arranged adjacent to at least one conductor connection device of each series terminal to selectively illuminate said conductor connection device with incidental light in accordance with a wiring diagram.

10. A series terminal assembly as defined in claim 9, wherein said at least one conductor connection device comprises a push-in connector.

11. A terminal assembly, comprising (a) at least one terminal block including at least two input plug-in slots, at least two output plug-in slots, and a configuration slot, said configuration slot including a configuration plug-in slot for each input plug-in slot and for each output plug-in slot, said configuration plug-in slot including a conductor connection device for connection with a conductor and a reflector for selectively illuminating said conductor connection device with incidental light in accordance with a wiring diagram; and (b) at least one electrical functional component connected with at least a portion of one of said input and output plug-in slots.

12. A terminal assembly as defined in claim 11, wherein said functional component comprises at least one switch.

13. A terminal assembly as defined in claim 11, and further comprising a base connected between said terminal block and said housing.

14. A terminal assembly as defined in claim 13, and further comprising a bracket extending around said electrical functional component and connected with one of said terminal block and said base.

15. A terminal assembly as defined in claim 11, and further comprising a pair of terminal blocks connected with a base for mounting on a rail.

16. A terminal assembly as defined in claim 15, wherein said plug-in slots define a plug connector, a plurality of adjacent plug connectors defining a terminal, each terminal block including a series of terminals.

17. A terminal assembly as defined in claim 15, and further comprising a pair of mating connectors connected with one side of said pair of terminal blocks via said plug-in slots, another side of said pair of terminal blocks containing a configuration slot.

18. A terminal assembly as defined in claim 17, wherein each of said mating connectors includes a plurality of co-planar contacts.

* * * * *